US007834815B2

(12) United States Patent
Li et al.

(10) Patent No.: US 7,834,815 B2
(45) **Date of Patent: *Nov. 16, 2010**

(54) CIRCULARLY POLARIZED DIELECTRIC ANTENNA

(75) Inventors: Qian Li, Ann Arbor, MI (US); Wladimiro Villarroel, Worthington, OH (US)

(73) Assignee: AGC Automotive America R & D, Inc., Ypsilanti, MI (US)

( * ) Notice: Subject to any disclaimer, the term of this patent is extended or adjusted under 35 U.S.C. 154(b) by 213 days.

This patent is subject to a terminal disclaimer.

(21) Appl. No.: 11/566,327

(22) Filed: Dec. 4, 2006

(65) Prior Publication Data

US 2008/0129616 A1 Jun. 5, 2008

(51) Int. Cl.
*H01Q 19/00* (2006.01)
*H01Q 19/10* (2006.01)
*H01Q 1/32* (2006.01)

(52) U.S. Cl. ..... 343/834; 343/833; 343/712; 343/713

(58) Field of Classification Search ..... 343/711, 343/712, 713, 873, 700 MS, 834, 833, 912, 343/837
See application file for complete search history.

(56) References Cited

U.S. PATENT DOCUMENTS

| | | | | |
|---|---|---|---|---|
| 4,486,758 | A | 12/1984 | deRonde | |
| 4,903,033 | A | 2/1990 | Tsao | |
| 4,914,445 | A | 4/1990 | Shoemaker | |
| 5,471,222 | A * | 11/1995 | Du | 343/713 |
| 5,497,164 | A | 3/1996 | Croq | |
| 5,523,727 | A | 6/1996 | Shingyoji | |
| 5,633,645 | A | 5/1997 | Day | |
| 5,760,744 | A * | 6/1998 | Sauer | 343/700 MS |
| 5,870,057 | A | 2/1999 | Evans et al. | |
| 5,940,036 | A * | 8/1999 | Oliver et al. | 343/700 MS |
| 5,945,950 | A | 8/1999 | Elbadawy | |
| 5,959,581 | A | 9/1999 | Fusinski | |
| 6,198,450 | B1 * | 3/2001 | Adachi et al. | 343/753 |
| 6,297,774 | B1 | 10/2001 | Chung | |
| 6,346,918 | B1 | 2/2002 | Munk | |
| 6,452,559 | B1 | 9/2002 | Yuanzhu | |
| 6,538,609 | B2 | 3/2003 | Nguyen et al. | |
| 6,661,386 | B1 | 12/2003 | Petros et al. | |
| 6,924,774 | B2 | 8/2005 | Komatsu et al. | |
| 6,995,709 | B2 | 2/2006 | Spittler | |
| 6,995,722 | B2 | 2/2006 | Komatsu et al. | |
| 7,019,699 | B2 | 3/2006 | Komatsu et al. | |
| 7,423,591 | B2 * | 9/2008 | Fox | 343/700 MS |
| 2002/0180646 | A1 * | 12/2002 | Kivekas et al. | 343/700 MS |

(Continued)

FOREIGN PATENT DOCUMENTS

| | | | |
|---|---|---|---|
| JP | 2000036708 | * | 2/2000 |

(Continued)

*Primary Examiner*—Hoang V Nguyen
*Assistant Examiner*—Robert Karacsony
(74) *Attorney, Agent, or Firm*—Howard & Howard Attorneys PLLC

(57) ABSTRACT

An antenna for radiating an electromagnetic field includes a ground plane, a feeding probe, and a dielectric layer. The dielectric layer is disposed on the ground plane and has a radiating surface. The feeding probe electrically is embedded in the dielectric layer, and the feeding probe excites the dielectric layer such that the electromagnetic field radiates from the radiating surface and achieves circular polarization radiation.

38 Claims, 8 Drawing Sheets

U.S. PATENT DOCUMENTS

2004/0169605 A1 9/2004 Komatsu et al.
2005/0052334 A1 3/2005 Ogino et al.
2005/0128161 A1 6/2005 Kagaya et al.
2005/0146478 A1 7/2005 Wang et al.
2005/0190106 A1 9/2005 Pros et al.
2005/0195114 A1 9/2005 Yegin et al.
2005/0259016 A1 11/2005 Yegin et al.
2006/0109178 A1 5/2006 Takeuchi et al.
2008/0036675 A1* 2/2008 Fujieda ..... 343/834

FOREIGN PATENT DOCUMENTS

WO WO2006/049002 * 5/2006

* cited by examiner

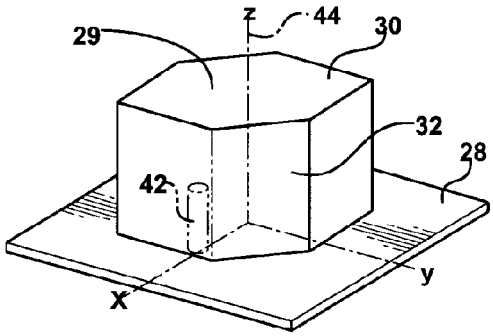
FIG - 2A
FIG - 2B
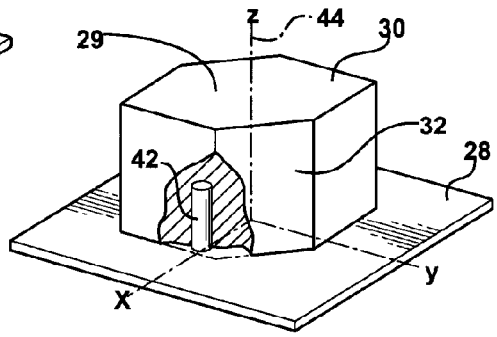
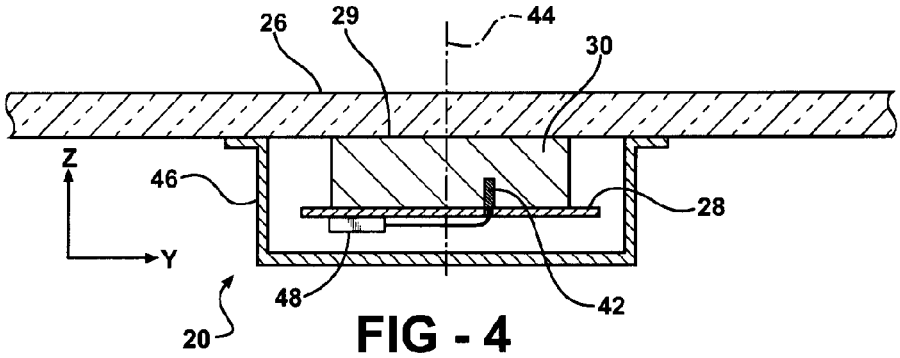
FIG - 4
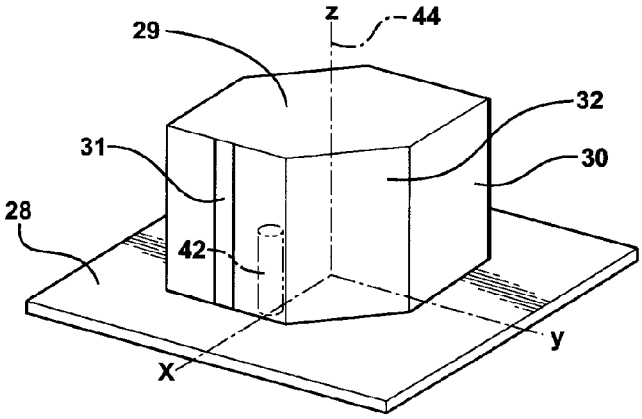
FIG - 5

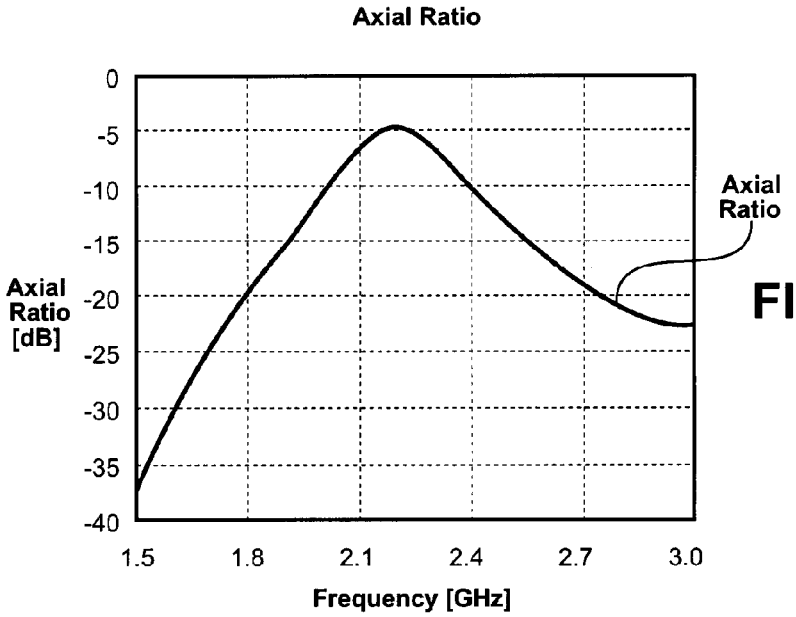
FIG - 8
FIG - 9
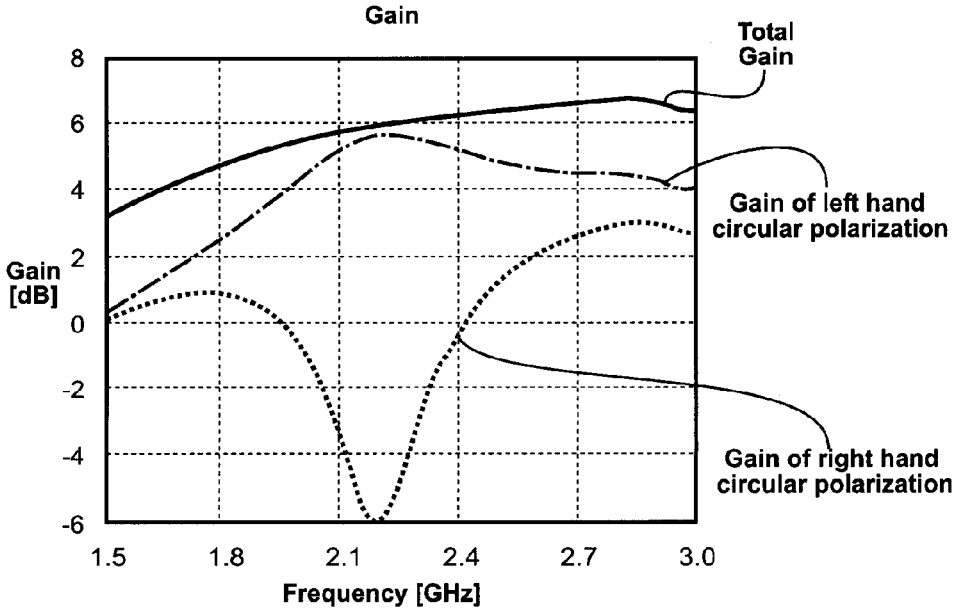

CIRCULARLY POLARIZED DIELECTRIC ANTENNA

BACKGROUND OF THE INVENTION

1. Field of the Invention

The subject invention generally relates to an antenna for receiving and/or transmitting a circularly polarized radio frequency (RF) signal.

2. Description of the Related Art

Various antennas for receiving circularly polarized RF signals are known in the art. In the antennas of the prior art, dielectric layers are typically used to isolate a radiation element, such as a discrete metal-based patch radiation element, from other elements of the antenna, such as a feeding probe and a ground plane. One example of such an antenna is disclosed in United States Patent Application Publication No. 2005/0195114 A1 to Yegin et al. (the Yegin et al. publication). The Yegin et al. publication discloses an antenna mounted to a windshield of an automobile. The antenna includes the ground plane supporting the dielectric layer. Further, the dielectric layer is supporting a metal layer having a slot, and the feeding probe excites the metal layer to radiate across the edges of the dielectric layer.

Although the antenna of the Yegin et al. publication can receive and/or transmit circularly polarized RF signals, there remains an opportunity to provide an antenna that achieves circular polarization radiation and/or linear polarization radiation from all surfaces of the dielectric layer that extend transverse relative to the ground plane or are parallel to and spaced from the ground plane and maintain or improve the performance of the antenna, including increasing bandwidth, increasing efficiency, decreasing size, decreasing manufacturing complexity, decreasing sensitivity, and eliminating surface wave radiation.

SUMMARY OF THE INVENTION AND ADVANTAGES

The invention provides an antenna for radiating an electromagnetic field. The antenna includes a ground plane and a dielectric layer disposed on the ground plane and having a radiating surface opposite the ground plane. The antenna further includes a feeding probe embedded in the dielectric layer for electrically exciting the dielectric layer such that the electromagnetic field radiates from the radiating surface and achieves circular polarization radiation.

Exciting the dielectric layer with the feeding probe generates the electromagnetic field to achieve circular polarization radiation in the radiating surface and eliminates the need for a discrete metal-based patch radiation element. That is, the antenna of the subject invention can operate independent of the metal-based patch radiation element disposed within the antenna. Accordingly, the antenna of the subject invention results in better gain performance at 20 to 30 degree elevation angles, as well as other performance characteristics such as increased bandwidth, increased efficiency, decreased size, decreased manufacturing complexity, decreased sensitivity, and minimized surface wave radiation.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2A is a perspective view of the preferred embodiment of the antenna having a dielectric layer disposed on a ground plane;

FIG. 2B is a partial cross-sectional perspective view of the antenna having a feeding probe embedded in the dielectric layer;

FIG. 4 is a partial cross-sectional side view of the antenna;

FIG. 5 is a perspective view of the antenna having a passive element disposed on a vertical surface of the dielectric layer;

FIG. 8 is a chart illustrating an axial ratio of the preferred embodiment of the antenna;

FIG. 9 is a chart illustrating radiation gains produced by the preferred embodiment of the antenna;

DETAILED DESCRIPTION OF THE INVENTION

Figure 1:
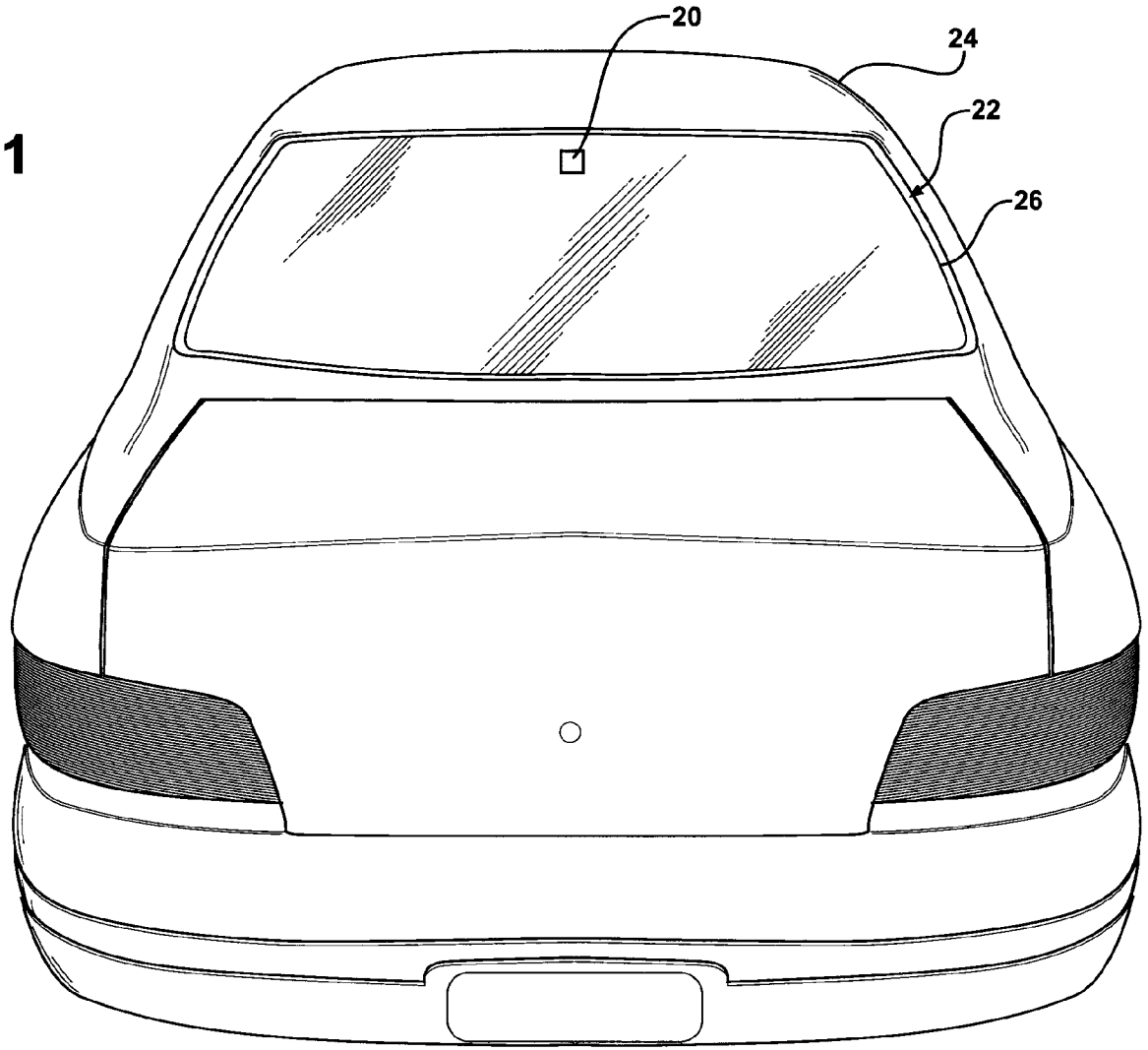
FIG. 1 is a perspective view of a vehicle with an antenna supported by a pane of glass of the vehicle.

Referring to the Figures, wherein like numerals indicate corresponding parts throughout the several views, an antenna for radiating an electromagnetic field is shown generally at reference numeral 20. In the illustrated embodiments, the antenna 20 is utilized to receive a circularly polarized radio frequency (RF) signal from a satellite. Those skilled in the art realize that the antenna 20 may also be used to transmit the circularly polarized RF signal. Specifically, the antenna 20 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 20 may also receive a right-hand circularly polarized (RHCP) RF signal.

Referring to FIG. 1, the antenna 20 is preferably integrated with a window 22 of a vehicle 24. The window 22 may be a rear window (backlite), a front window (windshield), or any other window of the vehicle 24. The antenna 20 may also be implemented in other situations completely separate from the vehicle 24, such as on a building or integrated with a radio receiver. Additionally, the antenna 20 may be disposed on other locations of the vehicle 24, such as on a side mirror.

Multiple antennas 20 may be implemented as part of a diversity system of antennas. For instance, the vehicle 24 of the preferred embodiment may include a first antenna 20 on the windshield and a second antenna 20 on the backlite. These antennas 20 would both be electrically connected to a receiver (not shown) within the vehicle 24. Those skilled in the art realize several processing techniques may be used to achieve diversity reception. In one such technique, a switch (not shown) may be implemented to select the antenna 20 that is currently receiving a stronger RF signal from the satellite.

The preferred window 22 includes at least one nonconductive pane 26. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

In the illustrated embodiments, the nonconductive pane 26 is implemented as at least one pane of glass. Of course, the window 22 may include more than one pane of glass. Those skilled in the art realize that automotive windows 22, particularly windshields, may include two panes of glass sandwiching an adhesive interlayer. The adhesive interlayer may be a layer of polyvinyl butyral (PVB). Of course, other adhesive interlayers would also be acceptable. The nonconductive pane 26 is preferably automotive glass and more preferably soda-lime-silica glass. The pane of glass defines a thickness between 1.5 and 5.0 mm, preferably 3.1 mm. The pane of glass also has a relative permittivity between 5 and 9, preferably 7. Those skilled in the art, however, realize that the nonconductive pane 26 may be formed from plastic, fiberglass, or other suitable nonconductive materials. Furthermore, the nonconductive pane 26 functions as a radome for the antenna 20. That is, the nonconductive pane 26 protects the other components of the antenna 20 from moisture, wind, dust, etc. that are present outside the vehicle 24.

Referring now to FIGS. 2A-B and 4, the antenna 20 includes a ground plane 28 for reflecting energy in a direction parallel to a vertical axis 44. The ground plane 28 is typically spaced from and disposed substantially parallel to the nonconductive pane 26. The ground plane 28 is formed of a generally flat electrically conductive material, such as a conductive metal like copper or aluminum. The ground plane 28 generally defines a rectangular shape, specifically a square shape. Accordingly, each side of the ground plane 28 may measure between 20 mm and 100 mm, and in a preferred embodiment, 60 mm. However, those skilled in the art realize that other shapes and sizes of the ground plane 28 may be implemented.

The electromagnetic field is radiated by a dielectric layer 30 sandwiched between the ground plane 28 and the nonconductive pane 26. The dielectric layer has a radiating surface 29 opposite the ground plane 28 and abutting the nonconductive pane 26. In addition to the abutting the nonconductive pane 26, the radiating surface 29 may be any exposed surface of the dielectric layer 30. Any surface of the dielectric layer 30 not abutting the ground plane 28 is exposed and may radiate. In other words, any exposed surface may be the radiating surface 29, and the dielectric layer 30 may include multiple radiating surfaces 29. Exciting the dielectric layer 30 causes the dielectric layer 30 to generate an electromagnetic field from the radiating surface 29. In doing so, the dielectric layer 30 radiates independent of a metal-based patch radiation element or layer. It should be understood that other surfaces of the dielectric layer 30 may radiate in addition to the radiating surface 29. In other words, any exposed surface of the dielectric layer 30 may act as the radiating surface 29. For instance, the exposed surfaces of the dielectric layer 30 include any surface not abutting the ground plane 28.

The dielectric layer 30 radiates the electromagnetic field according to numerous properties of the dielectric layer 30. One of those properties is a relative permittivity. The dielectric layer 30 has a relative permittivity between 1 and 100, and in a preferred embodiment, the relative permittivity is 9.4. It should be understood that the relative permittivity is uniform between the dielectric layer 30 and the radiating surface 29. On the other hand, those skilled in the art realize that the relative permittivity may be non-uniform between the dielectric layer 30 and the radiating surface 29. Another property of the dielectric layer 30 that influences the radiation of the electromagnetic field is a loss tangent. The dielectric layer 30 has a loss tangent between 0.001 and 0.3, and in a preferred embodiment, the loss tangent is 0.01. Additionally, the nonconductive pane 26 may operate in combination with the dielectric layer 30 to radiate the electromagnetic field.

As shown in FIGS. 3E-3H, and 3K-3L, the dielectric layer 30 may generally define a rectangular shape, and preferably a square shape. Each side of the dielectric layer 30 measures about one-quarter of a wavelength $\lambda$ of the RF signal to be received by the antenna 20. Accordingly, each side of the dielectric layer 30 may measure, for instance, between 20 mm and 100 mm depending on the wavelengths $\lambda$ of the RF signals. The RF signals transmitted by SDARS providers typically have a frequency between 2.32 GHz to 2.345 GHz. These frequencies translate into wavelengths $\lambda$ from 128 to 129 mm. Therefore, each side of the dielectric layer 30 measures preferably about 25 to 35 mm. Alternatively, as shown in FIGS. 3A-3D, and 3I-3J, the dielectric layer 30 may generally define a circular shape. However, those skilled in the art realize that there are alternative embodiments where the dielectric layer 30 defines other shapes and sizes depending on the type and frequency of the signal to be received and/or transmitted.

Referring again to FIGS. 2A-B and 4, the antenna 20 further includes a feeding probe 42 which is energized for electrically exciting the dielectric layer 30 such that the electromagnetic field radiates from the radiating surface 29 and achieves circular polarization radiation. The feeding probe 42 is embedded within the dielectric layer 30. The feeding probe may extend only partially into the dielectric layer 30 to embed the feeding probe 42 in the dielectric layer 30. Alternatively, the feeding probe 42 may extend completely to the surface of the dielectric layer 30 to embed the feeding probe 42 within the dielectric layer 30. In addition, the feeding probe 42 may be embedded in the dielectric layer 30 transverse to the ground plane 28. Here, the feeding probe 42 extends perpendicularly from the ground plane 28 toward the nonconductive pane 26. The feeding probe 42 also extends at least partially into the dielectric layer 30, and the feeding probe 42 may be completely surrounded by the dielectric layer 30. Although the ground plane 28 is electrically isolated from the feeding probe 42, the ground plane 28 provides a reference ground for the feeding probe 42. The feeding probe 42 is preferably formed of an electrically conductive wire and is generally parallel to the vertical axis 44 running through a center of the dielectric layer 30. It is preferred that the feeding probe 42 is spaced from the vertical axis 44 on the ground plane 28.

In a particularly preferred embodiment of the subject invention, the antenna 20 only consists essentially of the ground plane 28, the dielectric layer 30, and the feeding probe 42. In other words, the antenna 20 of this embodiment does not include a metal radiating element. As previously described, the dielectric layer 30 is disposed on the ground plane 28 and has the radiating surface 29 directly abutting the nonconductive pane 26. In this particular embodiment, air is not considered to be the dielectric layer 30. The feeding probe 42 is embedded in the dielectric layer 30 for electrically exciting the dielectric layer 30 such that the electromagnetic field radiates from the radiating surface 29 and achieves circular polarization radiation. The antenna 20 in this embodiment may still be used with other antenna components, such as a radome, which is known to those skilled in the art as a protective covering of the antenna 20. In addition, the antenna 20 of this embodiment may include multiple ground planes 28, a single dielectric layer 30 having multiple radiating surfaces 29, multiple dielectric layers 30 having multiple radiating surfaces 29, or multiple feed lines 42.

In another embodiment, referring to FIG. 5, those skilled in the art realize that a passive element may be used in addition to the feeding probe 42 for particular applications, including beam steering. For instance, the passive element may be an adhesive strip 31 attached to a vertical surface of the dielectric layer 30. The adhesive strip 31 excites the dielectric layer 30 to radiate the electromagnetic field from the radiating surface 29. Preferably, the adhesive strip 31 is formed from a metallic material, such as copper. Those skilled in the art realize that the adhesive strip 31 may be formed of other metals or combinations of metals.

Figure 13:
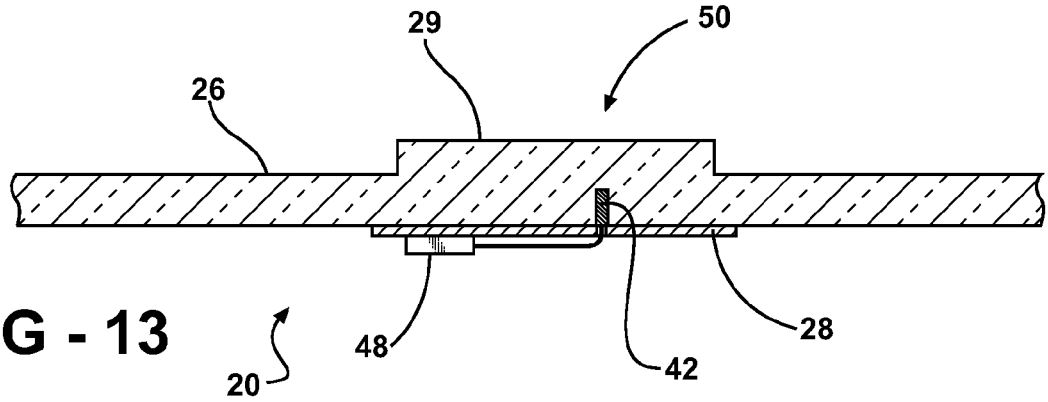
FIG. 13 is a partial cross-sectional side view of one embodiment of the antenna showing a protrusion of the pane of glass providing the dielectric layer.

In another alternative embodiment, as shown in FIG. 13, at least part of the nonconductive pane 26 may be the dielectric layer 30 as disclosed such that the nonconductive pane 26 itself radiates, allowing the antenna 20 to be embedded within the nonconductive pane 26. In this embodiment, the ground plane 28 abuts the nonconductive pane 26 and the feeding probe 42 extends into and excites the nonconductive pane 26 to generate the electromagnetic field. In order to prevent the entire nonconductive pane 26 from radiating and to overcome wave attenuation, a portion 50 of the nonconductive pane 26 may protrude outwardly and be excited to produce the electromagnetic field. Allowing the entire nonconductive pane 26 to radiate will cause wave attenuation. It is to be understood that there may be other ways to produce the electromagnetic field. Those skilled in the art realize that the size of the portion 50 of the nonconductive pane 26 that protrudes varies depending on the desired frequency. It is to be understood that the nonconductive pane 26 may be any window 22 in the vehicle 24, and preferably, the nonconductive pane 26 is the rear window. In this embodiment, the feeding probe 42 is embedded in the protruding portion 50 of the nonconductive pane 26 such that the nonconductive pane 26 radiates the electromagnetic field.

FIG. 5 is a schematic view of the feeding probe 42 embedded in the dielectric layer 30 offset from the center of the dielectric layer 30. The exact location of the feeding probe 42 relative to the ground plane 28 and the dielectric layer 30, as well as the length of the feeding probe 42, depend on both impedance and polarization characteristics of the specific antenna 20 design for a given application. For instance, under certain circumstances, it may be preferred that the length of the feeding probe 42 extend to the radiating surface 29 opposite the ground plane 28. Those skilled in the art realize that other locations and lengths of the feeding probe 42 may be implemented to excite the dielectric layer 30 and generate an electromagnetic field.

Referring back to FIGS. 2 and 3A-3L, the dielectric layer 30 defines at least one perturbation feature 32. The perturbation feature 32 of the dielectric layer 30 disturbs the electromagnetic field at appropriate locations to excite two orthogonal components of the RF signal with equal amplitude and in-phase quadrature. In other words, the perturbation feature 32 causes a "disturbance" in the electromagnetic field radiated by the dielectric layer 30. The perturbation feature 32 may be embodied in various quantities, configurations, shapes, and positions and define at least one dimension corresponding to a desired frequency range and axial ratio of the RF signal being received and/or transmitted. The desired frequency range is between 2.32 GHz and 2.345 GHz, and preferably 2.338 GHz, which corresponds to a center frequency used by XM® Satellite Radio.

Figure 3A:
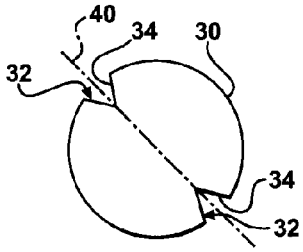
FIG. 3A is a top view of a dielectric layer of the antenna having a circular shape with a pair of perturbation features embodied as notches having triangular shapes.
Figure 3E:
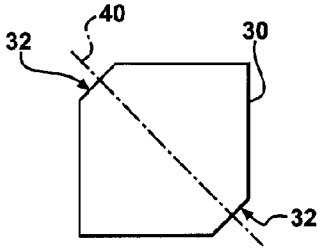
FIG. 3E is a top view of the dielectric layer of the antenna having a rectangular shape with a pair of perturbation features embodied as truncations of opposing corners of the dielectric layer.
Figure 3I:
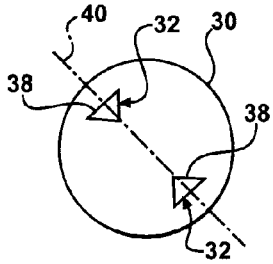
FIG. 3I is a top view of the dielectric layer of the antenna having a circular shape with a pair of perturbation features embodied as voids having triangular shapes.
Figure 3B:
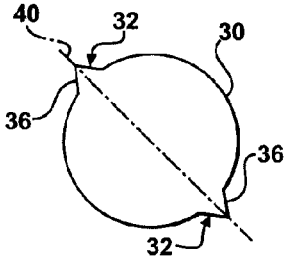
FIG. 3B is a top view of the dielectric layer of the antenna having a circular shape with a pair of perturbation features embodied as tabs having triangular shapes.
Figure 3F:
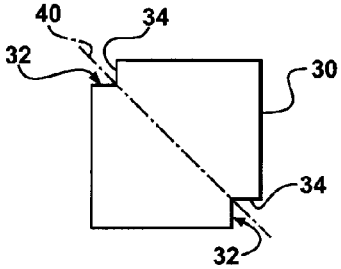
FIG. 3F is a top view of the dielectric layer of the antenna having a rectangular shape with a pair of perturbation features embodied as notches having a rectangular shape with sides generally parallel to the sides of the dielectric layer.
Figure 3J:
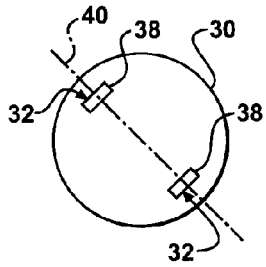
FIG. 3J is a top view of the dielectric layer of the antenna having a circular shape with a pair of perturbation features embodied as voids having rectangular shapes.
Figure 3C:
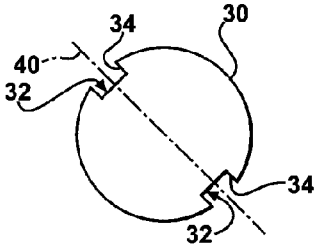
FIG. 3C is a top view of the dielectric layer of the antenna having a circular shape with a pair of perturbation features embodied as notches having rectangular shapes.
Figure 3G:
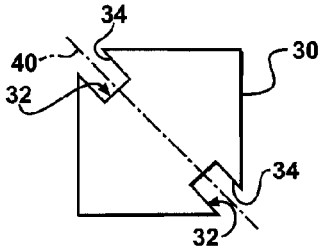
FIG. 3G is a top view of the dielectric layer of the antenna having a rectangular shape with a pair of perturbation features embodied as notches having rectangular shapes with sides generally non-parallel to the sides of the dielectric layer.
Figure 3K:
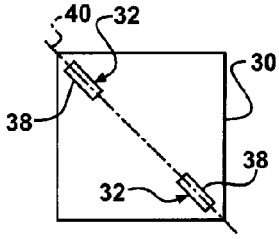
FIG. 3K is a top view of the dielectric layer of the antenna having a rectangular shape with a pair of perturbation features embodied as voids having rectangular shapes.
Figure 3D:
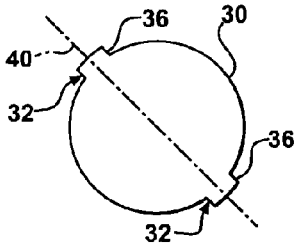
FIG. 3D is a top view of the dielectric layer of the antenna having a circular shape with a pair of perturbation features embodied as tabs having rectangular shapes.
Figure 3H:
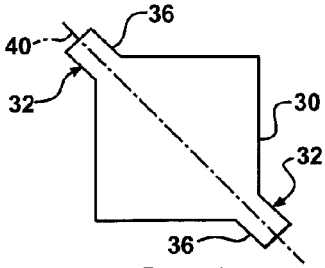
FIG. 3H is a top view of the dielectric layer of the antenna having a rectangular shape with a pair of perturbation features embodied as tabs having rectangular shapes.
Figure 3L:
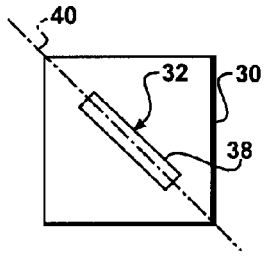
FIG. 3L is a top view of the dielectric layer of the antenna having a rectangular shape with a perturbation feature embodied as a void having a rectangular shape.

Referring to FIG. 3L, the dielectric layer 30 may have a single perturbation feature 32. However, typically, as shown in FIGS. 3A-3K, the dielectric layer 30 defines a pair of perturbation features 32. Each perturbation feature 32 of the pair is preferably defined on the dielectric layer 30 opposite one another. However, each perturbation feature 32 may be defined at locations not opposite to one another, as well. Furthermore, those skilled in the art realize that the dielectric layer 30 may define more than two perturbation features 32.

Referring to FIGS. 3A, 3C, 3F, and 3G, the perturbation feature 32 of the dielectric layer 30 may be implemented as a notch 34, preferably defined inward from the periphery towards the center. Of course, the notch 34 need not be defined towards a precise center of the dielectric layer 30, but simply inward from the periphery. The perturbation feature 32 of the dielectric layer 30 may also be implemented as a tab 36 projecting outward from the periphery away from the center, as shown in FIGS. 3B, 3D, and 3H. Likewise, the tab 36 need not project outward from a precise center of the dielectric layer 30. Also, as shown in FIGS. 3I-3L, the perturbation feature 32 may be defined as an aperture 38 fully bounded within the dielectric layer 30. Those skilled in the art realize that one perturbation feature 32 on the dielectric layer 30 may define the notch 34, while another perturbation feature 32 on the dielectric layer 30 may project the tab 36. Furthermore, those skilled in the art realize that other configurations for the perturbation features 32 other than the notches 34, tabs 36, and apertures 38 described above may be implemented.

Referring to FIGS. 3A, 3B, and 3I, the perturbation feature 32 may define a triangular shape, regardless of the configuration (notch 34, tab 36, void, or otherwise). As shown in FIGS. 3C, 3D, 3F, 3G, 3H, 3J, 3K, and 3L, the perturbation feature 32 may also define a rectangular shape. Referring to FIG. 3E, the perturbation feature 32 may be implemented as a truncation of a corner of a rectangular-shaped dielectric layer 30. Here, the perturbation features 32 are defined in opposing corners of the dielectric layer 30, and the perturbation features 32 are "cut-outs" of the opposing corners. In other words, the dielectric layer 30 has a rectangular configuration with opposing corners and the perturbation feature 32 is further defined as a pair of truncations defined at the opposite corners. The perturbation features 32 provide the dielectric layer 30 with circular polarization to receive the circularly polarized RF signal from the satellite. Those skilled in the art realize that other techniques of generating circular polarization may be implemented. Moreover, those skilled in the art realize that there are other suitable shapes for the perturbation features 32.

Referring to FIGS. 3A through 3L, a lateral axis 40 may be defined through a midpoint of the perturbation feature 32. It is preferred that each dielectric layer 30 is generally symmetrical about the lateral axis 40. This symmetry assists in providing a preferred axial ratio of about 0 dB. However, those skilled in the art realize that the antenna 20 may be implemented without the dielectric layer 30 being symmetrical about the lateral axis 40, particularly when a different axial ratio is desired.

Returning to FIG. 4, the antenna 20 may further include a cover 46 affixed to the nonconductive pane 26 to enclose the ground plane 28, the dielectric layer 30, and the feeding probe 42. The cover 46 protects the antenna 20 from dust, dirt, contaminants, accidental breakage, etc., as well as providing the antenna 20 with a more aesthetic appearance. Additionally, an amplifier 48 may be disposed inside the cover 46. In one embodiment, the amplifier 48 may be integrated into the ground plane 28. Furthermore, the ground plane 28 may be used to ground the amplifier 48. The amplifier 48 is electrically connected to the feeding probe 42 to amplify the RF signal received by the antenna 20. The amplifier 48 is preferably a low-noise amplifier (LNA) such as those well known to those skilled in the art.

The subject invention further includes a method of generating an electromagnetic field to achieve circular polarization radiation. Operationally, the method includes exciting the dielectric layer 30 of the antenna 20 such that the dielectric layer 30 generates the radiation pattern in the electromagnetic field. The method may further use the feeding probe 42 embedded in the dielectric layer 30. Here, the method includes energizing the feeding probe 42 to excite the dielectric layer 30. Finally, the method includes defining at least one of the perturbation features 32 in the dielectric layer 30 that corresponds to a desired frequency range and axial ratio of the RF signal.

Figure 6:
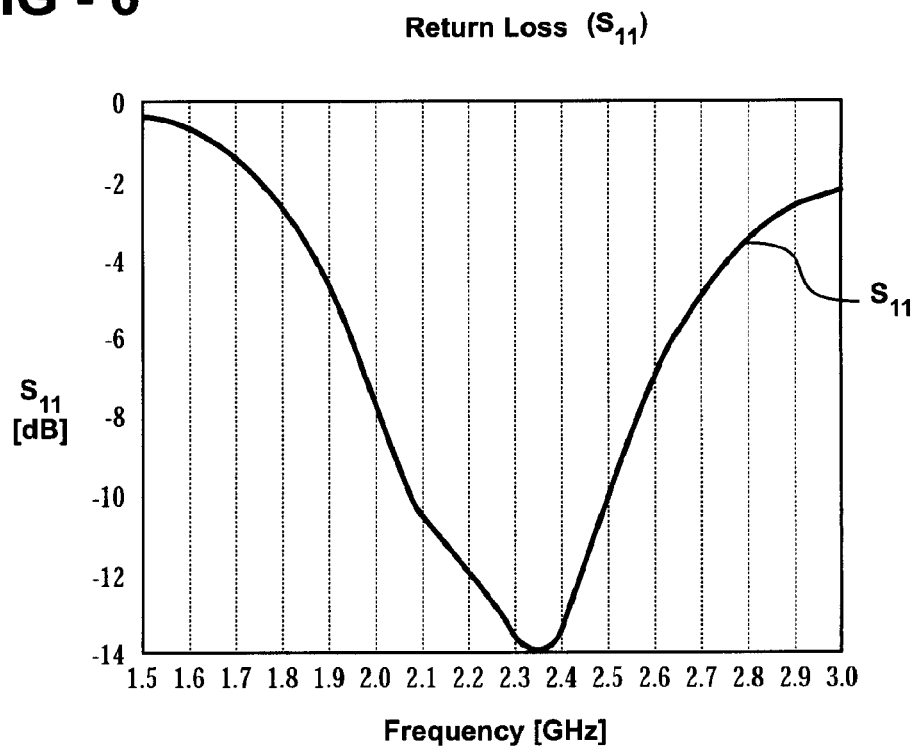
FIG. 6 is a chart illustrating the magnitude of the $S_{11}$ parameter of the preferred embodiment of the antenna.
Figure 7:
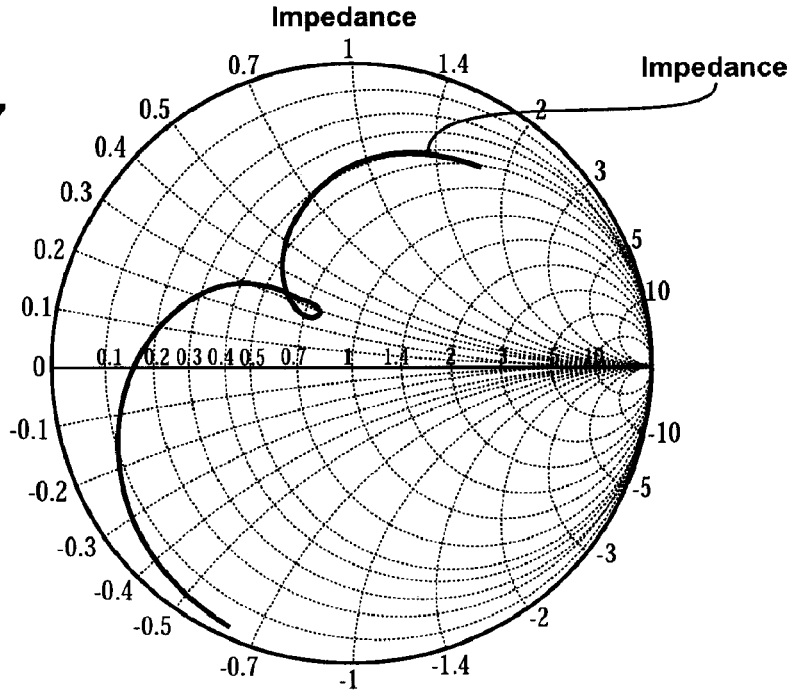
FIG. 7 is a chart illustrating input impedance of the preferred embodiment of the antenna.
Figure 10:
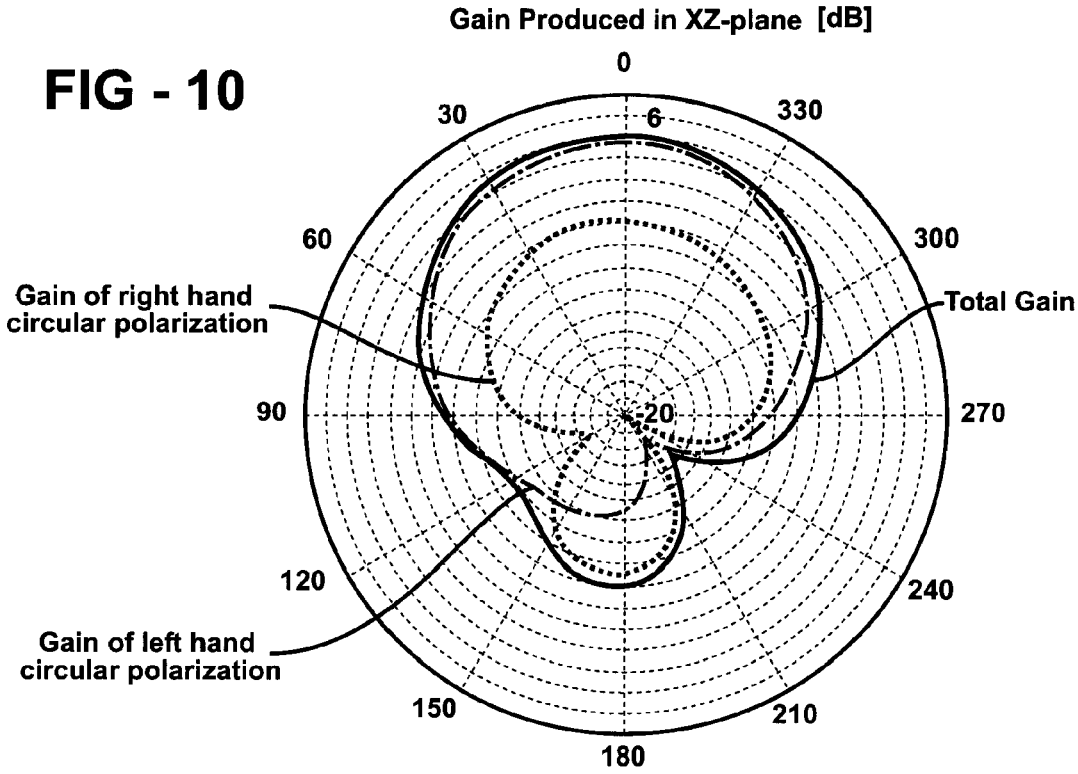
FIG. 10 is a chart illustrating total gain, right hand circular polarization gain, and left hand circular polarization gain produced in an XZ-plane by the preferred embodiment of the antenna.
Figure 11:
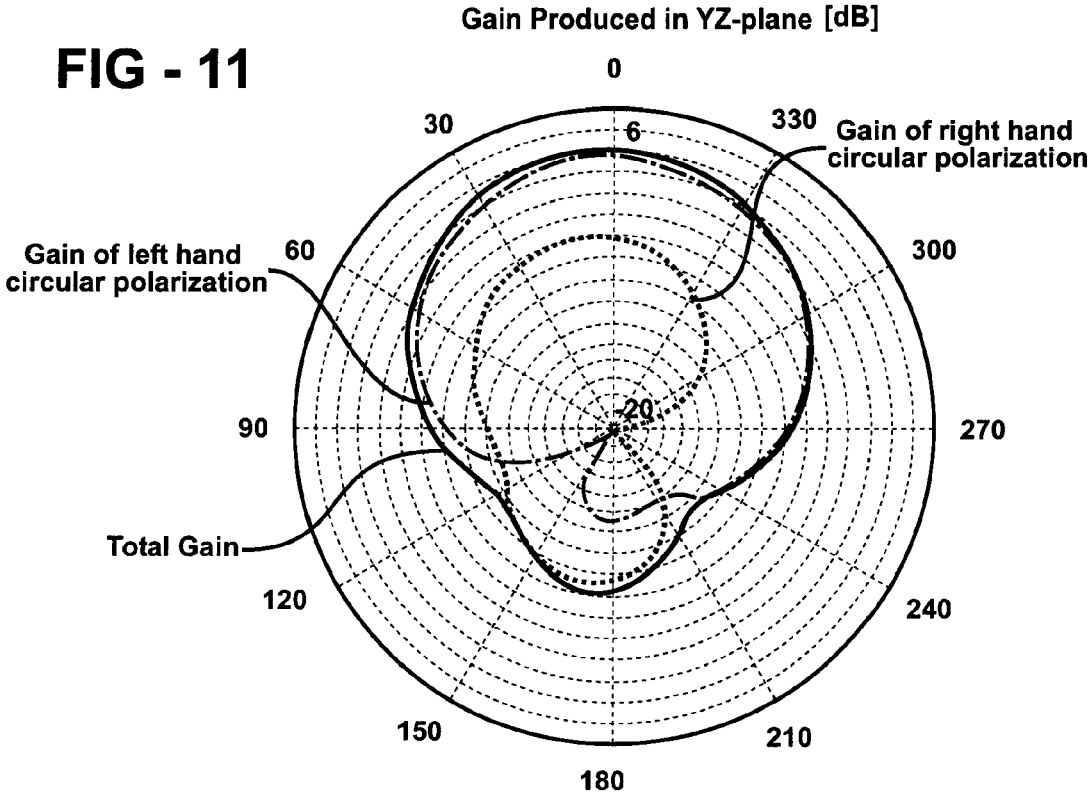
FIG. 11 is a chart illustrating total gain, right hand circular polarization gain, and left hand circular polarization gain produced in a YZ-plane by the preferred embodiment of the antenna.
Figure 12:
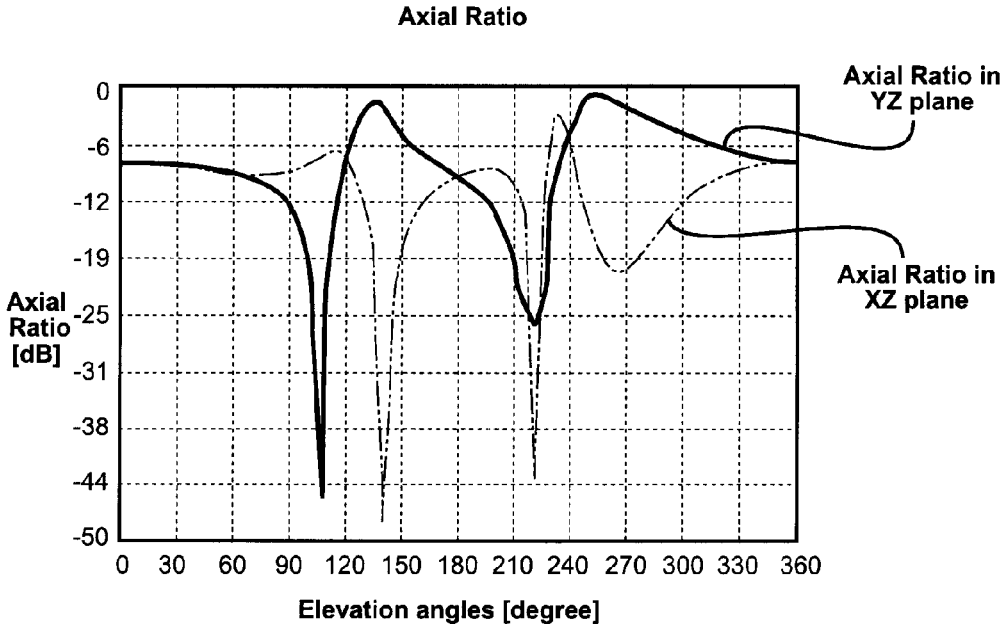
FIG. 12 is a chart illustrating the axial ratio of the preferred embodiment of the antenna in the XZ-plane and the YZ-plane.

When radiating, the antenna 20 is subject to a return loss depending on the frequency of the RF signal. FIG. 6 illustrates the magnitude of the $S_{11}$ parameter of the antenna 20 when the antenna 20 is operating within the desired frequency range. From this figure, the return loss is determined to be about 14 dB at the center frequency of the desired frequency range, and the desired frequency range provides a wider bandwidth of return loss values below 10 dB than typical patch-type antennas. Similarly, the antenna input impedance is shown in FIG. 7 to be a function of the frequency of the RF signal. FIGS. 8 and 9 illustrate the frequency response, axial ratio and gain of the antenna 20 covering the desired frequency range respectively. Referring to FIG. 8, the optimal axial ratio occurs when the antenna 20 operates at the center frequency in the desired frequency range. Likewise, as shown in FIG. 9, the maximum desired gain occurs when the antenna 20 operates at the center frequency in the desired frequency range. FIGS. 10 and 11 illustrate a gain pattern of the antenna 20 at the desired frequency range of operation (in our case 2.338 GHz). In FIG. 10, the gain is measured in an XZ-plane of the antenna 20, and in FIG. 11 the gain is measured in a YZ-plane, which is perpendicular to the XZ-plane. Finally, FIG. 12 illustrates an axial ratio pattern of the antenna 20 operating in the desired frequency range measured in the XZ-plane and the YZ-plane.

As set forth above, electrically exciting the dielectric layer 30 with the feeding probe 42 generates an electromagnetic field that radiates from the radiating surface 29 and achieves circular polarization radiation. Accordingly, this provides the antenna 20 of the subject invention with better gain performance at 20 to 30 degree elevation angles. The antenna 20 of the subject invention achieves circular polarization radiation and maintains or improves the performance when compared to patch-type antennas, including increased bandwidth, increased efficiency, decreased size, decreased sensitivity, and minimized surface wave radiation.

Obviously, many modifications and variations of the present invention are possible in light of the above teachings. The invention may be practiced otherwise than as specifically described within the scope of the appended claims.

What is claimed is:

1. An antenna for radiating an electromagnetic field, said antenna comprising:

a ground plane;

a dielectric layer disposed on said ground plane and having a radiating surface for radiating the electromagnetic field and at least one vertical surface generally perpendicular to said radiating surface;

a feeding probe embedded in said dielectric layer for electrically exciting said dielectric layer such that the electromagnetic field radiates from said radiating surfaces;

said dielectric layer further defining at least one perturbation feature for disturbing the electromagnetic field and achieving circular polarization radiation; and at least one passive element formed of a conductive material disposed adjacent said at least one vertical radiating surface and apart from said at least one perturbation feature.

2. An antenna as set forth in claim 1 wherein said radiating surface is opposite and spaced from said ground plane.

3. An antenna as set forth in claim 1 wherein said feeding probe extends only partially into said dielectric layer to embed said feeding probe in said dielectric layer.

4. An antenna as set forth in claim 1 wherein said feeding probe is embedded in said dielectric layer transverse to said ground plane.

5. An antenna as set forth in claim 1 wherein said at least one perturbation feature defines at least one dimension corresponding to a desired frequency range and axial ratio of a radio frequency (RF) signal.

6. An antenna as set forth in claim 1 wherein said dielectric layer includes a periphery and a center and wherein said at least one perturbation feature is further defined as a notch defined inward from said periphery towards said center.

7. An antenna as set forth in claim 1 wherein said dielectric layer includes a periphery and a center and wherein said at least one perturbation feature is further defined as a tab projecting outward from said periphery away from said center.

8. An antenna as set forth in claim 1 wherein said at least one perturbation feature is further defined as an aperture fully bounded within said dielectric layer.

9. An antenna as set forth in claim 1 further comprising a lateral axis defined through a center of said dielectric layer and through a midpoint of said at least one perturbation feature and wherein said dielectric layer is generally symmetrical about said lateral axis.

10. An antenna as set forth in claim 1 further comprising a vertical axis defined through a center of said dielectric layer and perpendicular to said ground plane and wherein said feeding probe extends from said ground plane parallel to and spaced from said vertical axis.

11. An antenna as set forth in claim 1 further comprising an amplifier electrically connected to said feeding probe for amplifying a signal received by said antenna.

12. An antenna as set forth in claim 1 wherein said dielectric layer has a relative permittivity between 1 and 100.

13. An antenna as set forth in claim 12 wherein said relative permittivity is uniform between said dielectric layer and said radiating surface.

14. An antenna as set forth in claim 12 wherein said relative permittivity is non-uniform between said dielectric layer and said radiating surface.

15. An antenna as set forth in claim 1 wherein said dielectric layer has a loss tangent between 0.001 and 0.03.

16. An antenna as set forth in claim 1 wherein said dielectric layer and said ground plane have a plurality of sides measuring between 20 mm and 100 mm.

17. An antenna as set forth in claim 1 wherein said dielectric layer is further defined as a nonconductive pane to radiate the electromagnetic field.

18. An antenna as set forth in claim 17 wherein said nonconductive pane is further defined as automotive glass.

19. An antenna as set forth in claim 1 wherein said at least one passive element is in contact with said at least one vertical surface.

20. An antenna as set forth in claim 1 wherein said at least one passive element is further defined as a strip of metal running between said ground plane and said radiating surface.

21. A window having an integrated antenna for radiating an electromagnetic field, said window comprising:

a nonconductive pane;

a ground plane spaced from and disposed substantially parallel to said nonconductive pane;

a dielectric layer sandwiched between said ground plane and said nonconductive pane;

said dielectric layer having a radiating surface for radiating the electromagnetic field and at least one vertical surface generally perpendicular to said radiating surface;

a feeding probe embedded in said dielectric layer said dielectric layer further defining at least one perturbation feature for disturbing the electromagnetic field and achieving circular polarization radiation; and at least one passive element formed of a conductive material disposed adjacent said at least one vertical surface and apart from said at least one perturbation feature.

22. A window as set forth in claim 21 wherein said radiating surface abuts said nonconductive pane.

23. A window as set forth in claim 21 wherein said feeding probe extends only partially into said dielectric layer to embed said feeding probe in said dielectric layer.

24. A window as set forth in claim 21 wherein said feeding probe is embedded in said dielectric layer transverse to said ground plane.

25. A window as set forth in claim 21 wherein said at least one perturbation feature defines at least one dimension corresponding to a desired frequency range and axial ratio of a radio frequency (RF) signal.

26. A window as set forth in claim 21 wherein said dielectric layer includes a periphery and a center and wherein said at least one perturbation feature is further defined as at least one of a notch defined inward from said periphery towards said center and a tab extending outward from said periphery away from said center.

27. A window as set forth in claim 21 wherein said dielectric layer has a rectangular configuration with opposing corners and wherein said at least one perturbation feature is further defined as a pair of truncations defined in said opposing corners.

28. A window as set forth in claim 21 wherein said at least one perturbation feature is further defined as an aperture fully bounded within said dielectric layer.

29. A window as set forth in claim 21 further comprising a lateral axis defined through a center of said dielectric layer and through a midpoint of said at least one perturbation feature and wherein said dielectric layer is generally symmetrical about said lateral axis.

30. A window as set forth in claim 21 further comprising a vertical axis defined through a center of said dielectric layer and wherein said feeding probe extends from said ground plane parallel to and spaced from said vertical axis.

31. A window as set forth in claim 21 further comprising an amplifier electrically connected to said feeding probe for amplifying a signal received by said antenna.

32. A window as set forth in claim 21 wherein said dielectric layer has a relative permittivity between 1 and 100.

33. An antenna as set forth in claim 32 wherein said relative permittivity is uniform between said dielectric layer and said radiating surface.

34. An antenna as set forth in claim 32 wherein said relative permittivity is non-uniform between said dielectric layer and said radiating surface.

35. A window as set forth in claim 21 wherein said dielectric layer has a loss tangent between 0.001 and 0.03.

36. A window as set forth in claim 21 wherein said dielectric layer and said ground plane have a plurality of sides measuring between 20 mm and 100 mm.

37. A window as set forth in claim 21 wherein said nonconductive pane is further defined as automotive glass.

38. A window having an integrated antenna for radiating an electromagnetic field, said window comprising:

a pane of automotive glass defining a radiating portion of automotive glass protruding from said pane of automotive glass for radiating the electromagnetic field;

a ground plane disposed on said pane of automotive glass; and a feeding probe embedded in said portion of said pane of automotive glass for exciting said pane of automotive glass such that said pane of automotive glass radiates the electromagnetic field.

* * * * *